US011369018B2

(12) United States Patent
Dekker

(10) Patent No.: US 11,369,018 B2
(45) **Date of Patent: *Jun. 21, 2022**

(54) DEVICE HAVING DATA SIGNAL TRANSMISSION OVER POWER

(71) Applicant: Light Corp Inc., Grand Haven, MI (US)

(72) Inventor: Ted Dekker, Norton Shores, MI (US)

(73) Assignee: Light Corp Inc., Grand Haven, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/176,295

(22) Filed: Feb. 16, 2021

(65) Prior Publication Data

US 2021/0168921 A1 Jun. 3, 2021

Related U.S. Application Data

(63) Continuation of application No. 16/840,588, filed on Apr. 6, 2020, now Pat. No. 10,959,314, which is a continuation of application No. 16/291,082, filed on Mar. 4, 2019, now Pat. No. 10,757,792.

(60) Provisional application No. 62/643,357, filed on Mar. 15, 2018.

(51) Int. Cl.
*H05B 47/185* (2020.01)

(52) U.S. Cl.
CPC ..... *H05B 47/185* (2020.01)

(58) Field of Classification Search
CPC ..... H05B 47/185
USPC ..... 315/294
See application file for complete search history.

(56) References Cited

U.S. PATENT DOCUMENTS

| | | | | |
|---|---|---|---|---|
| 8,805,550 | B2 * | 8/2014 | Chemel | H05B 47/155 700/22 |
| 10,344,954 | B1 * | 7/2019 | Tischler | F21V 23/003 |
| 2004/0227472 | A1 * | 11/2004 | Gaus, Jr. | H05B 47/185 315/314 |
| 2009/0289578 | A1 * | 11/2009 | Peng | H05B 47/18 315/294 |
| 2011/0084614 | A1 | 4/2011 | Eisele et al. | |
| 2014/0132171 | A1 | 5/2014 | Otake et al. | |

(Continued)

OTHER PUBLICATIONS

Singh, et al., DC Power-Line Communication Reference Design, catalog, Oct. 2013, pp. 1-47, TIDU160, Texas Instruments Incorporated, Dallas, Texas. <http://www.ti.com/lit/ug/tidu160/tidu160.pdf>.

(Continued)

*Primary Examiner* — Don P Le
(74) *Attorney, Agent, or Firm* — Bodman PLC

(57) ABSTRACT

A system includes a power source and a plurality of modules, where each module has a control for controlling a function of the module and a user input actuatable by a user. The plurality of modules are electrically connected in series with a power conductor electrically connected between each adjacent module, where the power source provides power to each module over the power conductor. In response to actuation by the user of the user input on a select module of the plurality of modules, the control of the select module generates a control signal that is transmitted to each other module over the power conductor, such that the control of each other module controls the associated function in the same manner as the select module.

20 Claims, 9 Drawing Sheets

(56) References Cited

U.S. PATENT DOCUMENTS

| | | | | |
|---|---|---|---|---|
| 2015/0115809 | A1* | 4/2015 | Siessegger | H05B 47/105 315/185 R |
| 2015/0115830 | A1* | 4/2015 | Siessegger | H04B 3/548 315/291 |
| 2015/0351194 | A1* | 12/2015 | Sung | H05B 47/18 315/153 |
| 2016/0081160 | A1* | 3/2016 | Vangeel | H05B 47/10 315/152 |
| 2016/0174333 | A1* | 6/2016 | Kim | H05B 47/115 315/152 |
| 2016/0286627 | A1 | 9/2016 | Chen et al. | |
| 2017/0175987 | A1* | 6/2017 | Newton | F21V 23/0435 |
| 2018/0219582 | A1* | 8/2018 | Scott | H04B 3/548 |
| 2019/0158265 | A1 | 5/2019 | Hwang et al. | |
| 2019/0260829 | A1 | 8/2019 | Cencini et al. | |

OTHER PUBLICATIONS

Singh, et al., Power line communication implementation for DC applications, article, Feb. 2014, EDN Network, https://www.edn.com/design/power-management/4427860/1/Power-line-communication-implementation-for-DC-applications.

Non-Final Office Action dated Sep. 16, 2020, by the U.S. Patent and Trademark Office relating to U.S. Appl. No. 16/840,588.

* cited by examiner

DEVICE HAVING DATA SIGNAL TRANSMISSION OVER POWER

CROSS-REFERENCE TO RELATED APPLICATIONS

The present application is a continuation of U.S. Non-provisional application Ser. No. 16/840,588, filed Apr. 6, 2020, which is a continuation of U.S. Non-provisional application Ser. No. 16/291,082, filed Mar. 4, 2019, which claims benefit and priority under 35 U.S.C. § 119(e) of U.S. provisional application Ser. No. 62/643,357, filed Mar. 15, 2018, which are hereby incorporated herein by reference in their entireties.

TECHNICAL FIELD

This disclosure relates generally to communication between connected devices and, more particularly, to data communication between modular devices connected in a closed system, such as a lighting system.

BACKGROUND

It is generally known to transmit data signals over power lines, such as for broadband and narrowband power line communication use in utility smart grid applications.

SUMMARY

The present disclosure provides a modular system (e.g., modular lighting system or modular power distribution system) or lighting fixtures or power distribution fixtures that utilize data signal transmission over power conductors or lines and that provide control of one or more modules or fixtures through the power conductor or line. The system may include a power source that provides power to one or more modules or fixtures over a power conductor or line, such as a cable. At least one of the modules or fixtures may include a light element operable to emit light. The modules or fixtures may be electrically connected in series or in parallel with the power conductor or line electrically connected between each adjacent module. In response to actuation by a user of a user input on a select module or fixture, the control of the select module or fixture may control the element of the select module, while also generating a control signal that is transmitted to one or more other modules over the power conductor or line. The control of each other module, in response to receiving the control signal, may control the associated light element in the same or similar manner as the select module.

According to one aspect of the present disclosure, a system includes a power source and a plurality of modules. Each lighting module has a control for controlling a function of the module and a user input actuatable by a user. The plurality of modules are electrically connected in series or parallel with a power conductor electrically connected between each adjacent module, where the power source provides power to each module over the power conductor. In response to actuation by the user of the user input on a select module of the plurality of modules, the control of the select module controls the function of the select module and generates a control signal. The control signal is transmitted to each other module of the plurality of modules over the power conductor, such that the control of each other module of the plurality of modules, responsive to receiving the control signal, controls the associated function in the same manner as the function of the select module.

According to another aspect of the present disclosure, a lighting module includes a power cable that is configured to transmit power to the lighting module and configured to electrically connect to at least one other lighting module in series. The lighting module also includes a lighting element operable to emit light and a user input actuatable by a user. A control of the lighting module is operable, responsive to actuation by the user of the user input, to control the lighting element. The control, responsive to actuation by the user of the user input, transmits a control signal over the power cable to the at least one other lighting module connected in series to the lighting module.

According to yet another aspect of the present disclosure, a method includes connecting a plurality of lighting modules in series with a power conductor electrically connected between each adjacent lighting module, where a power source provides power to each lighting module over the power conductor. A user input may be actuated on a select lighting module of the plurality of lighting modules to the control a lighting element of the select lighting module and generate a control signal. The control signal may be transmitted to each other lighting module of the plurality of lighting modules over the power conductor. The light source of each other lighting module may be controlled to emit light in the same manner as the lighting element of the select lighting module in responsive to receiving the control signal from the select lighting module.

These and other objects, advantages, purposes, and features of the present disclosure will become apparent upon review of the following specification in conjunction with the drawings.

DETAILED DESCRIPTION

A modular system operates to provide a plurality of modules or fixtures that utilize data signal transmission over a power conductor, and provides control over all modules through the power conductor. The system includes a plurality of modules and each module includes a control and a user input that is actuatable by a user. The control controls a function of the module and the user input. Each module is electrically connected in a series or in parallel with a power conductor, such as a line, cable, or the like. The power conductor is electrically connected between each adjacent module and provides power to each module over the power conductor. When a user actuates the user input on a select module, the control of the select module controls the function and generates a control signal that is transmitted over the power conductor to each other module. In response to receiving the control signal, the control of each other module controls the associated function in the same manner as the control of the select module. In this way, a user is provided with the ability to control all modules from any one of the modules and each module is only connected through a power conductor.

Figure 1:
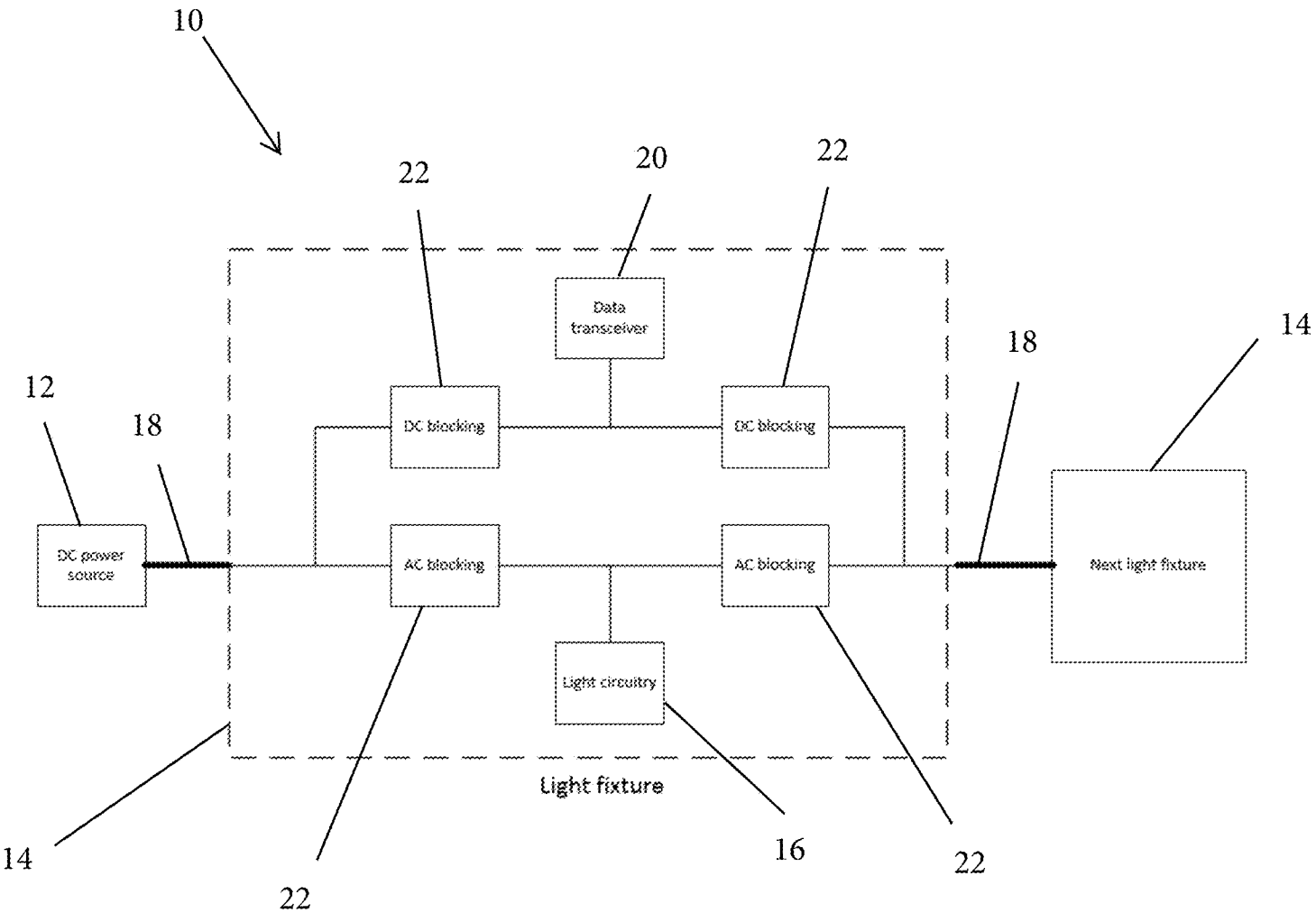
FIG. 1 is a schematic of a lighting system in accordance with the present disclosure.

Referring now to the drawings and the illustrative examples depicted therein, a lighting system 10 includes a power source 12. As shown in FIG. 1, the power supply 12 is a DC power supply, but an AC power supply may also be used. The lighting system 10 also includes a plurality of lighting modules 14. While lighting modules 14 are illustrated, it is understood that other types of modules may be used instead. For example, the modules may provide wireless charging of devices (or other power distribution), audio (e.g., a speaker), or digital communication (e.g., USB connections), where such alternative examples of modules, module engagement, and connectivity between modules as described in U.S. patent application Ser. No. 16/282,827, filed on Feb. 22, 2019, which is hereby incorporated herein by reference in its entirety.

Figure 2A:
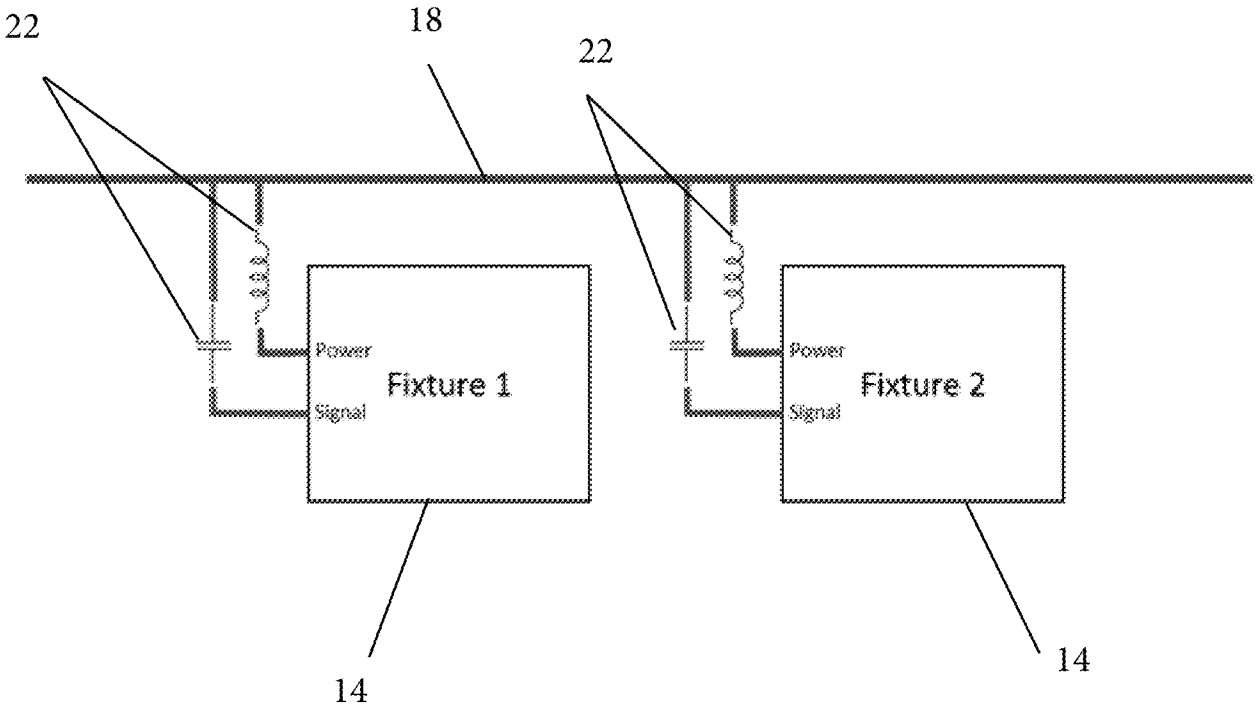
FIGS. 2A and 2B are schematics of a lighting system in accordance with the present disclosure.
Figure 2B:
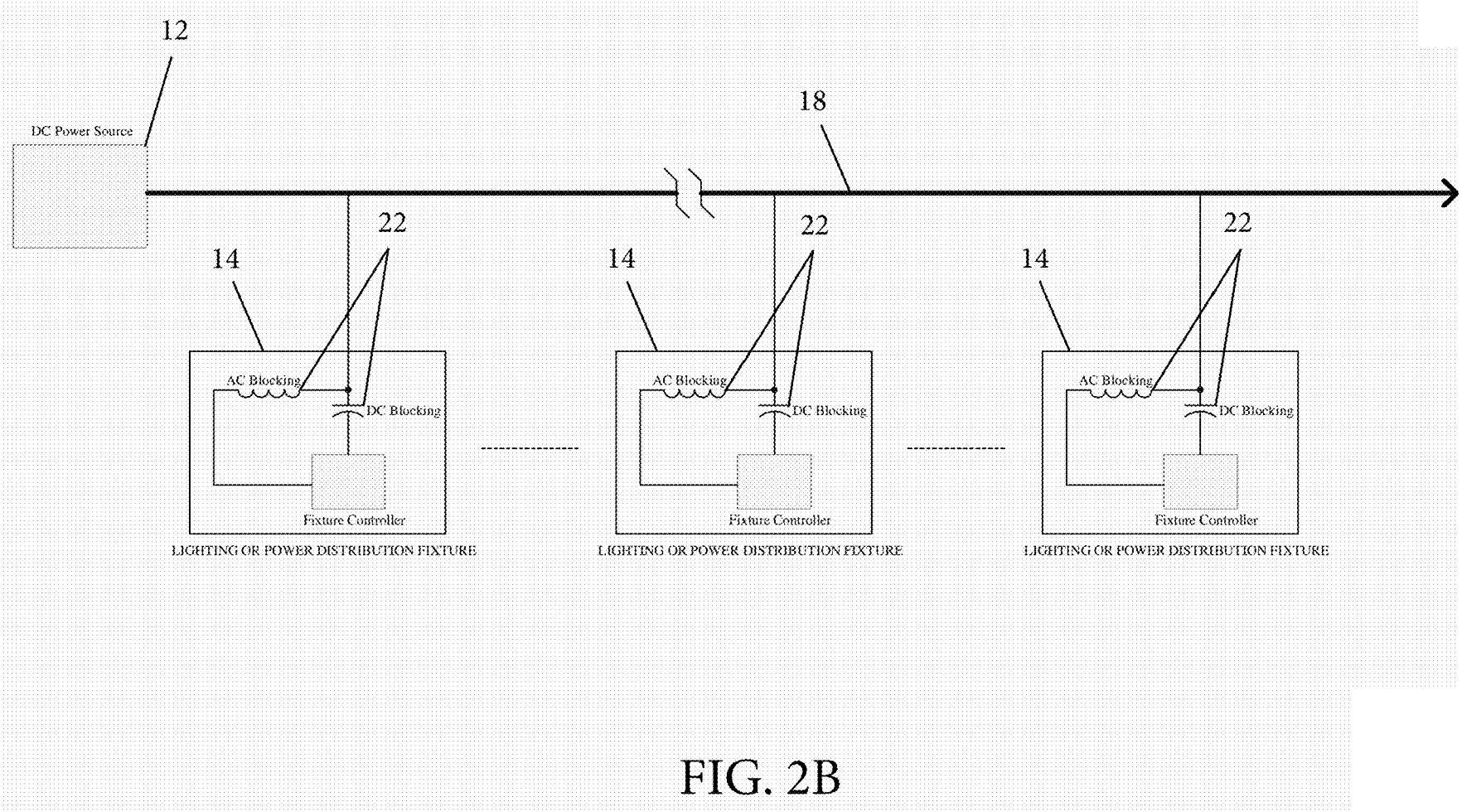
Figure 4:
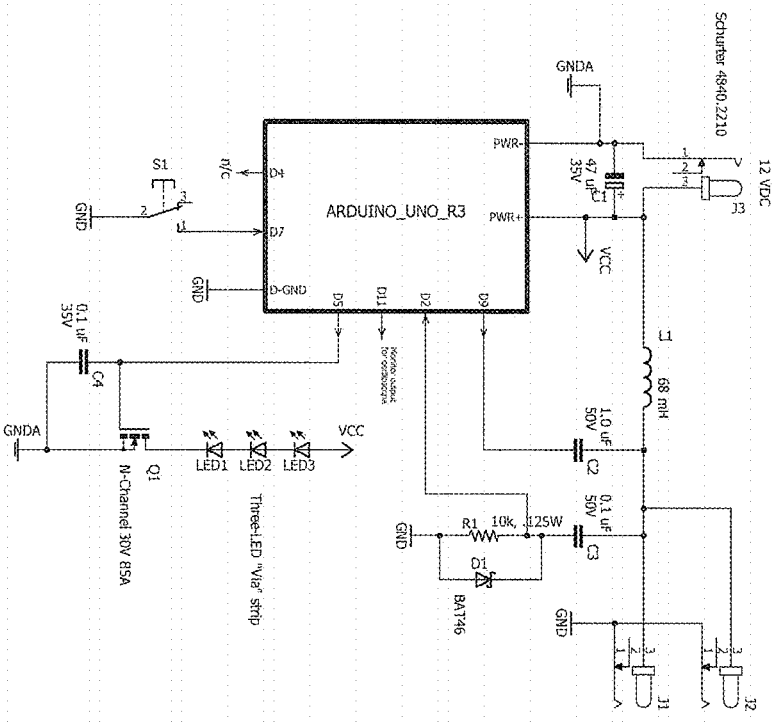
FIG. 4 is a schematic of a lighting module in accordance with the present disclosure.

Each lighting module 14 includes a lighting element and associated circuitry 16. The lighting element may include light emitting diode (LED) lighting, but any type or combination of lighting technology may be used, such as fluorescent, incandescent, or the like. Each lighting module 14 also includes at least one user input. In FIG. 4, the user input is shown as switch S1, but the user input may take any suitable form, such as a button, a touch pad, a slider, and the like. Optionally, each lighting module 14 and the power source 12 are connected in series (as illustrated in FIG. 1), with each connected with a power conductor, such as shown as a single cable 18. A common term for such a series is a "daisy-chain." With the daisy chain, the power supply 12 provides power to the first lighting module 14 in the chain, which in turn provides power to the next lighting module 14 in the chain, and so on until the end of the chain. In other examples, such as illustrated in FIGS. 2A and 2B, the modules 14 are connected in parallel.

Figure 5:
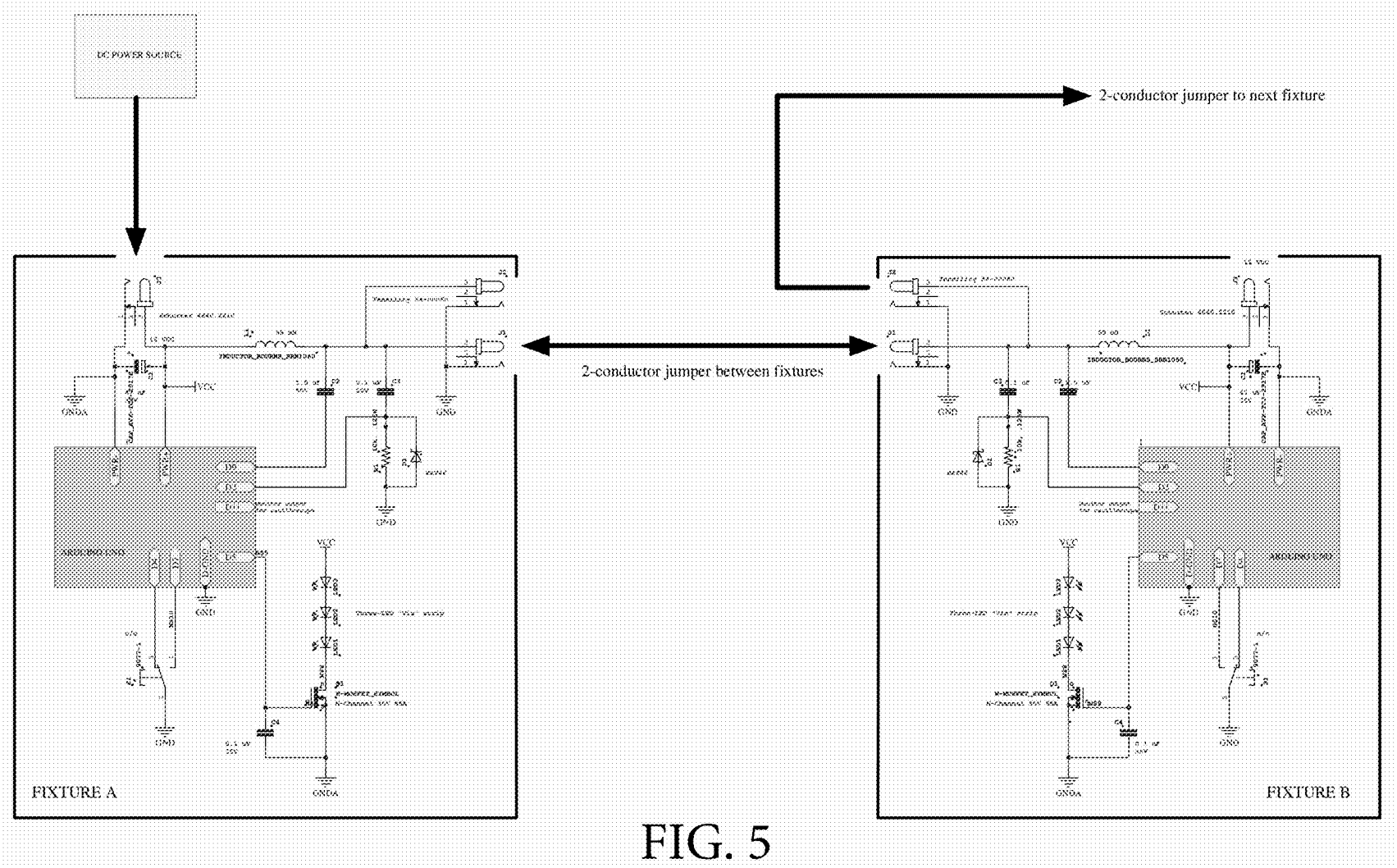
FIG. 5 is a schematic of a lighting system in accordance with the present disclosure.

Each lighting module 14 includes a control or data transceiver 20. As shown in FIGS. 4 and 5, the control may comprise an Arduino microcontroller, but any manner of suitable control may be used (microprocessor, FPGA, CPLD, etc.). When a user actuates the user input, such as flipping a switch, pressing a button, etc., the control 20 responds by controlling the lighting element of the lighting module 14. This control might include turning the lighting element on or off, adjusting the intensity of the illumination of the lighting element, adjusting the color of the light emitted by the lighting element, and the like. Each lighting module 14 may include any number of user inputs and a user input may be used to control more than one function. For example, pressing a button might have one effect on the light element 16 while pressing and holding the button might have a different effect on the light element 16. The control may control or adjust an illumination intensity, a color temperature, among other conceivable lighting conditions or settings of the light emitted by the light element 16. Thus, the light module may include one or more lighting element that is capable of dimming, changing color, or otherwise altering its emitted light.

In addition to controlling the light element 16, the control 20 also generates a control signal. The control signal is transmitted to each other lighting module over the power conductor, such as the cable 18 shown in FIGS. 1-2B. To accomplish this, the control signal is transmitted to each lighting module 14 adjacent to the lighting module of the control 20. As shown in FIGS. 2A and 2B, the modules 14 may also be connected in parallel, and the power cable 18 may pass through each lighting module 14 with each lighting module "tapping off" of the power cable 18 to receive power and the control signal. Alternatively, each lighting module may repeat or in some way retransmit the power and control signals to adjacent lighting modules 14. When connected in series, as shown in FIG. 1, each control 20 in the daisy-chain may control the light element 16 in the same manner, thus allowing the user to control every lighting module 14 in the series simultaneously from a user input at a single module. For example, a user actuating the control on a select lighting module to turn off the select lighting module will turn off all of the connected lighting modules nearly simultaneously. As another example, a user actuating the control on a select lighting module to adjust the light intensity of the select lighting module will adjust the light intensity at the same or similar level or all of the connected lighting module. The control signal may be transmitted over the power conductor or cable using any half or full-duplex asynchronous serial protocol, which generally does not require an accompanying timing signal on another conductor, such as a USB protocol, RS-422 protocol, RS-485 protocol, or the like. Synchronous interfaces (e.g., SPI protocol, I2C protocol, etc.) may also be used to transmit the control signal, such as by multiplexing the signals onto a single conductor or line or the like.

Figure 3:
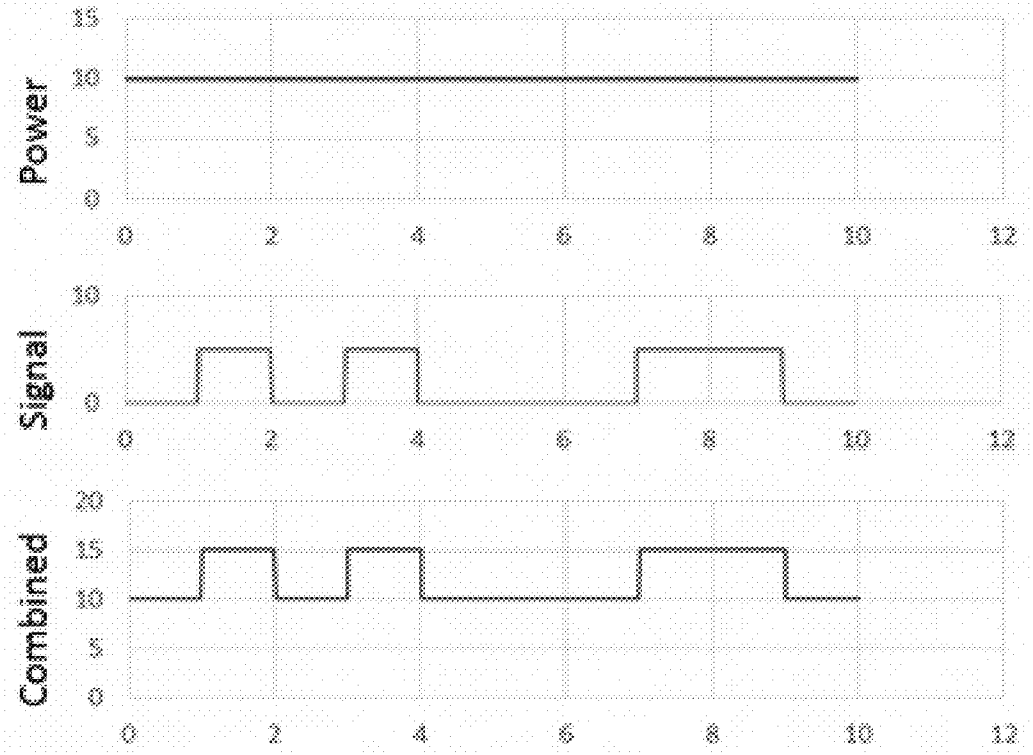
FIG. 3 is a graph of the power and control signal from the lighting system of FIG. 1.

Each lighting module 14 includes filtering 22 to separate power and the control signal. As shown in FIGS. 1-5, the power may be DC and DC blocking or filtering may be used to isolate the control signal and AC blocking or filtering may be used to isolate the power. In this way, the control 20 may only receive the control signal and the light element 16 may only receive the power. For example, as shown in FIG. 3, the power supply may provide 10V DC power and the control may provide a control signal that pulses between 0V and 5V. The combined signal will be a signal that pulses between 10V and 15V. As shown in FIGS. 1-2B, 4, and 5, the DC filtering may include an inductor and the AC filtering may include a capacitor. The specific values of the filtering components (e.g., capacitors and inductors) can be determined based upon the frequency of the control signal, the frequency of the power signal (if AC), and any other signal integrity concerns. Alternatively, AC power could be provided by the power source 12 and the control signal could be generated at a different frequency than that of the power. Appropriate filtering to separate the AC frequencies may then be used in place of the DC filtering to separate the power and the control signal. Such signal manipulation is well known in the art. While shown in the illustrated examples as separate elements, the control 20 and light element 16 may be integrated into a single component.

Figure 6A:
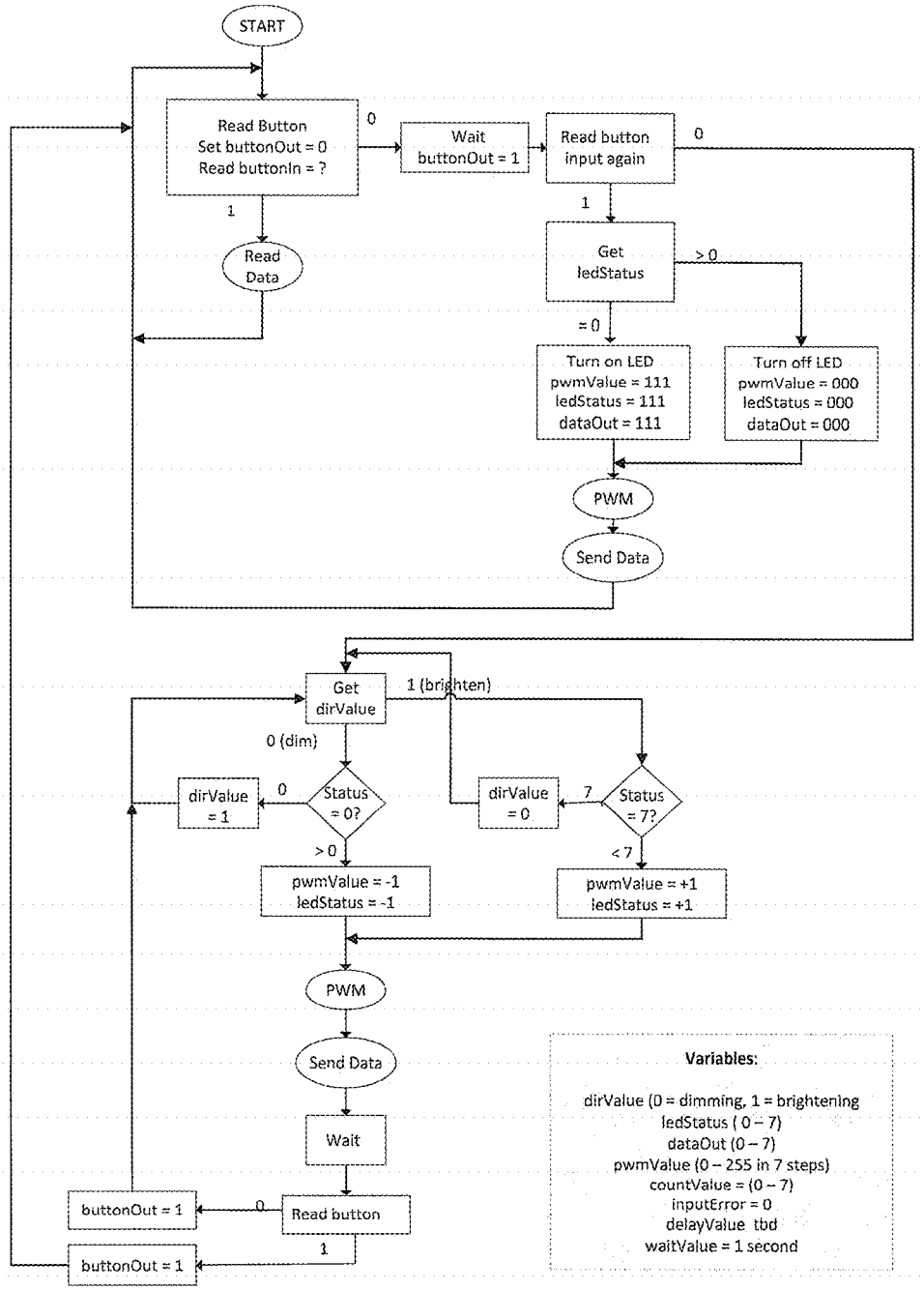
FIGS. 6A and 6B are flow charts for a control of a lighting module in accordance with the present disclosure.
Figure 6B:
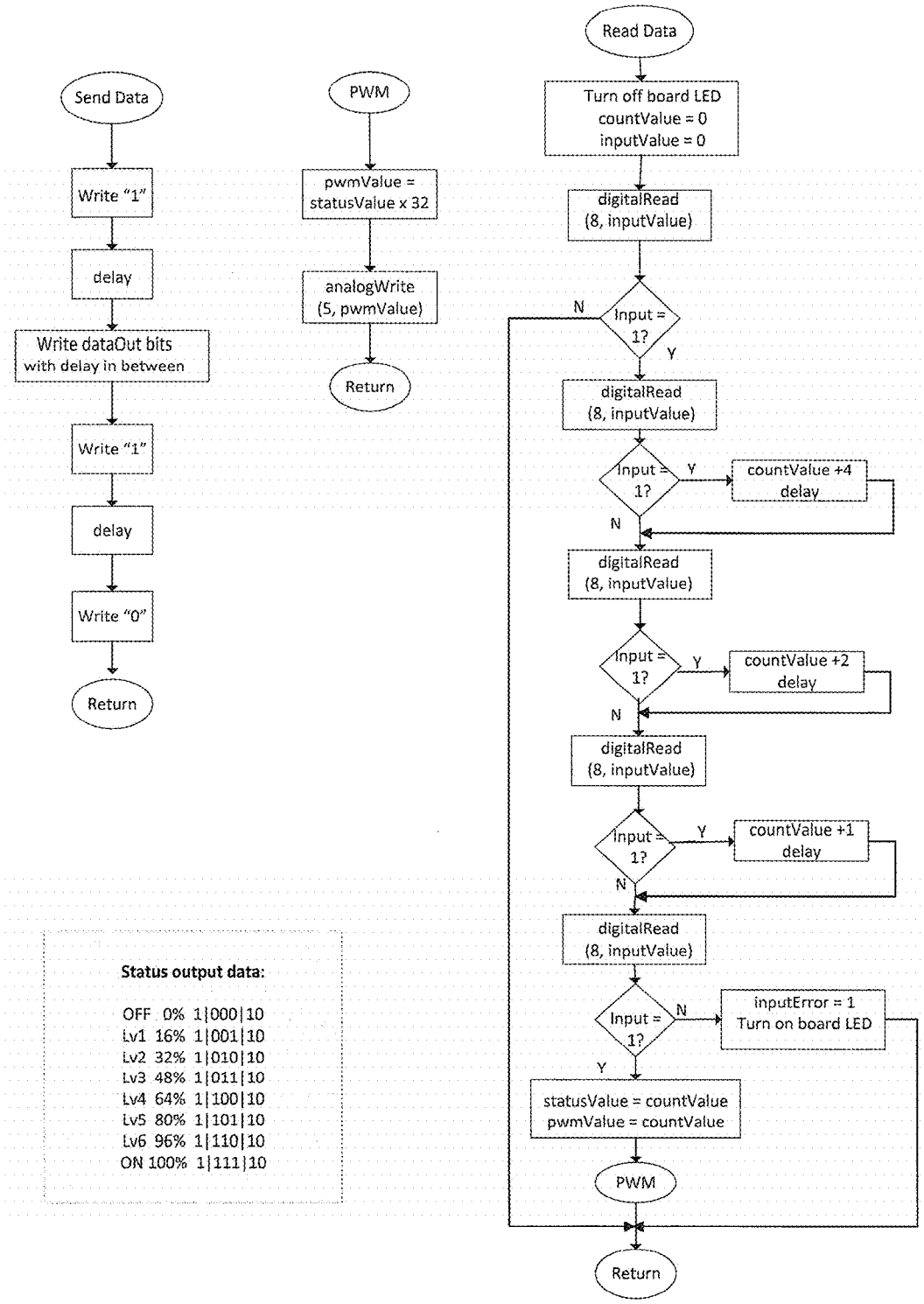

FIGS. 6A and 6B illustrate a flowchart showing the process the control 20 may use to monitor and respond to the user input and control the light element 16. For example, the control 20 may wait until the user input is pressed. Once a button press is detected, the control 20 may determine how long the button is actuated. If the button is actuated and released, the control may respond by inverting the current operational state of the light element. For example, switch the light from on to off or off to on. If the control 20 determines that the button is being continually actuated (e.g., a button is being held actuated), the control 20 may respond by dimming or brightening the light element.

Figure 7:
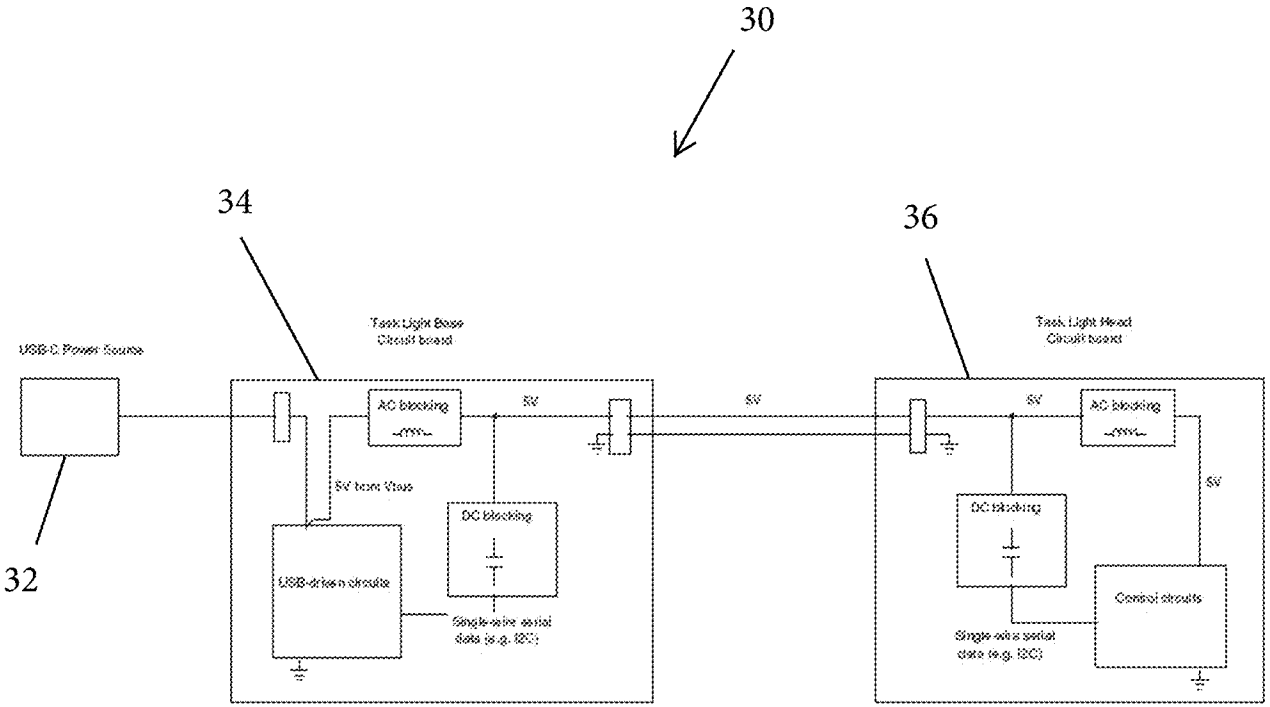
FIG. 7 is a schematic of an additional embodiment of a lighting system having of task light in accordance with the present disclosure.

In another example of the present disclosure, a task light 30 may include a power source 32, a task light base 34, and a task light head 36. The task light base 34 may transmit power and a control signal to a task light head 36 over a power conductor, such as a conductive structural member, line, or cable 38, as shown in FIG. 7. The power conductor, such as the cable 38, may include two conductive elements: one for a DC voltage and one for signal ground. The task light base 34 and task light head 36 may include filtering, such as DC filtering/blocking and AC filtering/blocking to separate the AC and DC components of the combined power and control signal. For example, as shown in FIG. 7, a USB power source may provide 5V DC power to the task light base 34. When a user input is actuated on the task light base 34, a control may generate a control signal using an asynchronous serial wire protocol such as I2C. Also, it is conceivable that the control signal may be generated using an SPI protocol, such as by multiplexing signals onto a single conductor or line. The control signal may be combined with the 5V power signal and transmitted to the task light head 36. The task light head 36 may filter the signal back into the respective 5V DC power signal and the serial control signal. A control in the task light head 36 may then control a light element included in the task light head.

In yet another example of the present disclosure, a low voltage power distribution system may include a panel that is capable of receiving and supporting one or more application modules at multiple engaged locations on the panel, so as to position the modules at desirable locations. The panel has a conductive portion that is connected to an auxiliary power source, such as a power supply that is connected to a standard electrical outlet. A contact of the application module may engage the conductive portion of the panel to form an electrical connection between the contact and the conductive portion of the panel, so as to supply electrical power to the application module and components thereof. Accordingly, an engaged application module may transmit a control signal to another engaged accessory module over the conductive portion, such as a conductive panel or line or the like. When a user input is actuated on the accessory module, a control may generate a control signal using an asynchronous serial protocol. The control signal may be combined with the 5V power signal and transmitted to the other engaged application module. The other engaged application module may filter the signal back into the respective 5V DC power signal and the serial control signal. A control in one engaged application module may then control a light element or other component included in the other engaged application module. Such an example is further disclosed in U.S. described in U.S. patent application Ser. No. 16/282,827, which is incorporated herein by reference.

Thus, the present disclosure provides a lighting system, module, or fixture that provides a control signal and a power signal on the same power conductor. The system includes circuitry to separate the power and the control signal. This allows cost and size to be reduced by eliminating the need for additional conductors and/or multi-pin connectors and increase aesthetic value by decreasing the number and/or size of visible wires connecting the lighting modules.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A system comprising:

a power conductor having a plurality of engagement locations disposed over the power conductor at spaced locations from each other;

a first application module comprising a first device, a first control for controlling a function of the first device, and a first connector configured to engage the power conductor at a select one of the plurality of engagement locations;

a second application module comprising a second device, a second control for controlling a function of the second device, and a second connector configured to engage the power conductor at a different select one of the plurality of engagement locations;

wherein, when the first and second connectors are engaged at the power conductor, the power conductor is configured to deliver power to the first and second devices; and wherein, responsive to an input signal received at the first application module, the first control generates a control signal that is directly transmitted from the first application module to the second application module over the power conductor.

2. The system of claim 1, wherein the second application module comprises filtering that is configured to filter the control signal from power provided to the second application module and configured to filter the power from the control signal provided to the second control.

3. The system of claim 1, wherein, responsive to receiving the control signal, the second control of the second application module controls the function of the second device in the same manner as the function of the first device.

4. The system of claim 1, wherein the first and second devices each comprise a light element operable to emit light.

5. The system of claim 4, wherein the first and second controls control brightness or color of the light emitted by the respective light element.

6. The system of claim 1, wherein the first application module comprises a housing that at least partially encloses the first device, and wherein the first connector is disposed at an exterior surface of the housing.

7. The system of claim 1, wherein the power conductor comprises a positive conductive member and a negative conductive member, the positive and negative conductive members disposed adjacent to each other at each of the plurality of engagement locations.

8. The system of claim 7, wherein the first and second connectors each comprise a pair of contacts configured to engage the positive and negative conductive members for the respective first or second connector to engage the power conductor.

9. The system of claim 1, wherein at least one of the first or second application modules comprises a power outlet for electrically connecting an accessory device.

10. The system of claim 1, wherein the power conductor is disposed at one of a furniture piece, a tack board, a partition, or a divider.

11. A system comprising:

a power conductor assembly comprising a positive conductive member and a negative conductive member insulated from each other, the power conductor assembly configured to connect to a power source;

a plurality of application modules each configured to engage a select location of a plurality of locations disposed at the power conductor assembly, wherein each of the plurality of application modules comprises:

a control for controlling a function of the respective application module;

a first contact configured to engage the positive conductive member; and a second contact configured to engage the negative conductive member, wherein, with the first and second contacts engaged with the positive and negative conductive members, the respective application module is configured to receive power from the power source; and wherein, responsive to a data signal received at a first application module of the plurality of application modules engaged at the panel assembly, the control of the first application module transmits the data signal over the power conductor assembly to a second application module of the plurality of application modules engaged at the panel assembly.

12. The system of claim 11, wherein the second application module comprises filtering that is configured to filter the data signal from power provided to the second application module and configured to filter the power from the data signal provided to the second control.

13. The system of claim 11, wherein, responsive to receiving the data signal, the second control of the second application module controls a function of the second application module.

14. The system of claim 13, wherein the first and second application modules each comprise a light element operable to emit light, and wherein, responsive to receiving the data signal, the second control of the second application module controls a function of the light element of the second application module in the same manner as the light element of the first application module.

15. The system of claim 11, wherein the first and second application modules each comprises a housing that at least partially encloses a light element, and wherein the first and second connectors are disposed at an exterior surface of the housing.

16. The system of claim 11, wherein at least one of the first or second application modules comprises a power outlet for electrically connecting an accessory device.

17. The system of claim 11, wherein the second application module comprises a speaker, and wherein, responsive to receiving the data signal, the control of the second application module controls the function of the speaker.

18. The system of claim 11, wherein, responsive to receiving the control signal, the control of the second application module controls the function of the second application module in the same manner as the function of the first application module.

19. The system of claim 11, wherein the power conductor assembly is disposed at one of a furniture piece, a tack board, a partition, or a divider.

20. A system comprising:

a power conductor assembly comprising a positive conductive member and a negative conductive member, the positive and negative conductive members insulated from each other and configured to connect to a power source, the power conductor assembly having a plurality of engagement locations defined at spaced locations from each other;

a first application module comprising a first device, a first control for controlling a function of the first device, and a first connector having contacts configured to engage the positive and negative conductive members at a select one of the plurality of engagement locations to deliver power to the first device;

a second application module comprising a second device, a second control for controlling a function of the second device, and a second connector having contacts configured to engage the positive and negative conductive members at a different select one of the plurality of engagement locations to deliver power to the second device; and wherein, responsive to an input signal received at the first application module, the first control generates a control signal that is directly transmitted from the first application module to the second application module over one of the positive or negative conductive members, and wherein, responsive to receiving the control signal, the second control controls the function of the second device in the same manner as the function of the first device.

* * * * *